US011646483B2

(12) United States Patent
Ahmed et al.

(10) Patent No.: US 11,646,483 B2
(45) Date of Patent: May 9, 2023

(54) UNIVERSAL ANTENNA MOUNT AND BASE PLATE THEREFOR

(71) Applicant: CommScope Technologies LLC, Hickory, NC (US)

(72) Inventors: Firoz Ahmed, Houston, TX (US); Michael S. McFall, Mansfield, TX (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/501,079

(22) Filed: Oct. 14, 2021

(65) Prior Publication Data

US 2022/0037769 A1 Feb. 3, 2022

Related U.S. Application Data

(62) Division of application No. 16/585,417, filed on Sep. 27, 2019, now Pat. No. 11,152,688.

(60) Provisional application No. 62/737,353, filed on Sep. 27, 2018.

(51) Int. Cl.

| | |
|---|---|
| ***H01Q 1/12*** | (2006.01) |
| ***H01Q 1/24*** | (2006.01) |
| ***H01Q 1/36*** | (2006.01) |

(52) U.S. Cl.
CPC ..... *H01Q 1/246* (2013.01); *H01Q 1/1207* (2013.01); *H01Q 1/36* (2013.01)

(58) Field of Classification Search
CPC ..... H01Q 1/246; H01Q 21/26; H01Q 1/12–36
See application file for complete search history.

(56) References Cited

U.S. PATENT DOCUMENTS

| | | | | |
|---|---|---|---|---|
| 5,988,583 | A * | 11/1999 | Rhine | H01Q 1/12 248/539 |
| 6,008,772 | A | 12/1999 | Legay et al. | |
| 9,433,034 | B2 | 8/2016 | Hendrix et al. | |
| 9,711,871 | B2 * | 7/2017 | Jones | H01Q 21/28 |
| 10,886,595 | B1 | 1/2021 | Ortel et al. | |
| 11,018,430 | B2 * | 5/2021 | Kildal | H01Q 9/28 |
| 2011/0168220 | A1 * | 7/2011 | Prusmack | E04H 15/50 135/120.3 |

* cited by examiner

*Primary Examiner* — Hasan Islam
(74) *Attorney, Agent, or Firm* — Myers Bigel, P.A.

(57) ABSTRACT

A mount for an antenna includes: a base panel; a plurality of first spokes extending radially outwardly from the base panel, each of the first spokes being cantilevered and including a first slot; and a plurality of second spokes, each of the second spokes including a vertical member and a flange that is generally parallel with the base panel and generally perpendicular to the vertical member, each of the second spokes including a second slot, and each of the flanges including a third slot.

19 Claims, 7 Drawing Sheets

UNIVERSAL ANTENNA MOUNT AND BASE PLATE THEREFOR

RELATED APPLICATION

The present application is a divisional of and claims priority to U.S. patent application Ser. No. 16/585,417, filed Sep. 27, 2019, now U.S. Pat. No. 11,152,688, which claims priority from and the benefit of U.S. Provisional Patent Application No. 62/737,353, filed Sep. 27, 2018, the disclosure of which is hereby incorporated herein in its entirety.

FIELD OF THE INVENTION

The present application is directed generally toward communication antennas, and more particularly to mounting structures for communications antennas.

BACKGROUND

As wireless data service demands have grown, a conventional response has been to increase the number and capacity of conventional cellular Base Stations (Macro-Cells). Such Macro-Cells are typically mounted on antenna towers. A conventional antenna tower has three or four legs on which antennas and supporting remote radio units (RRUs) are mounted. However, in some environments structures known as "monopoles" are used as mounting structures. Monopoles are typically employed when fewer antennas/RRUs are to be mounted, and/or when a structure of less height is required.

In addition, Macro-Cell sites are becoming less available, and available spectrum limits how much additional capacity can be derived from a given Macro-Cell. Accordingly, small cell RRU and antenna combinations have been developed to "fill in" underserved or congested areas that would otherwise be within a Macro-Cell site. Deployment of small cells, particularly in urban environments, is expected to continue to grow. Often such small cell configurations (sometimes termed "metrocells") are mounted on monopoles.

Some small cell antenna configurations may comprise a generally cylindrical unit with three antennas deployed at 120 degree angles to one another. An exemplary cylindrical antenna unit is shown in U.S. Pat. No. 9,433,034 to Hendrix, the disclosure of which is hereby incorporated herein in its entirety. Such antenna units are typically mounted on the top of a monopole.

In view of the foregoing, it may be desirable to provide additional monopole mounting arrangements.

SUMMARY

As a first aspect, embodiments of the invention are directed to a mount for an antenna comprising: a base panel; a plurality of first spokes extending radially outwardly from the base panel, each of the first spokes being cantilevered and including a first slot; and a plurality of second spokes, each of the second spokes including a vertical member and a flange that is generally parallel with the base panel and generally perpendicular to the vertical member, each of the second spokes including a second slot, and each of the flanges including a third slot.

As a second aspect, embodiments of the invention are directed to a base plate for an antenna mount comprising: a main panel; a central opening in the main panel; a first set of discontinuous slots in the main panel that define a first circle radially outward from the central opening; a second set of discontinuous slots in the main panel that define a second circle radially outward from the first circle; and a plurality of extensions that extend generally radially outwardly from the main panel, each of the extensions including a third slot.

DETAILED DESCRIPTION

Figure 1:
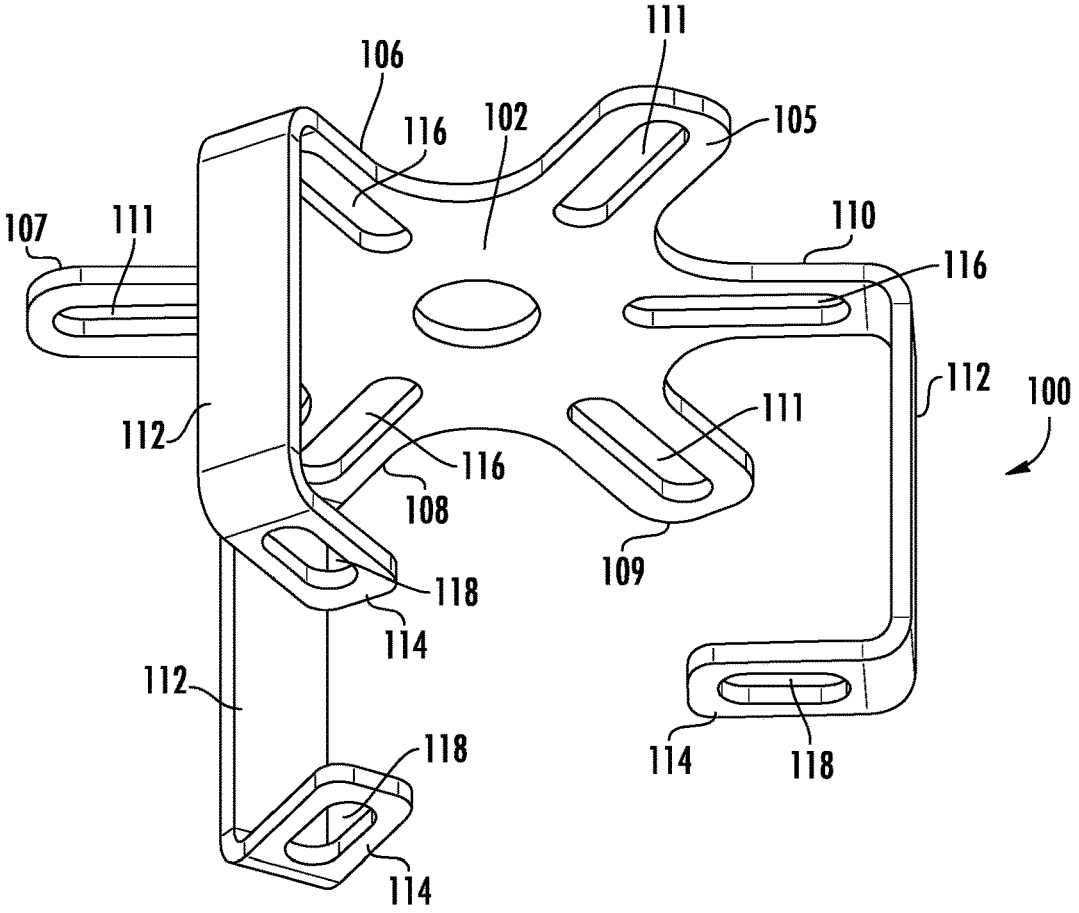
FIG. 1 is a bottom perspective view of an antenna mount according to embodiments of the invention.
Figure 2:
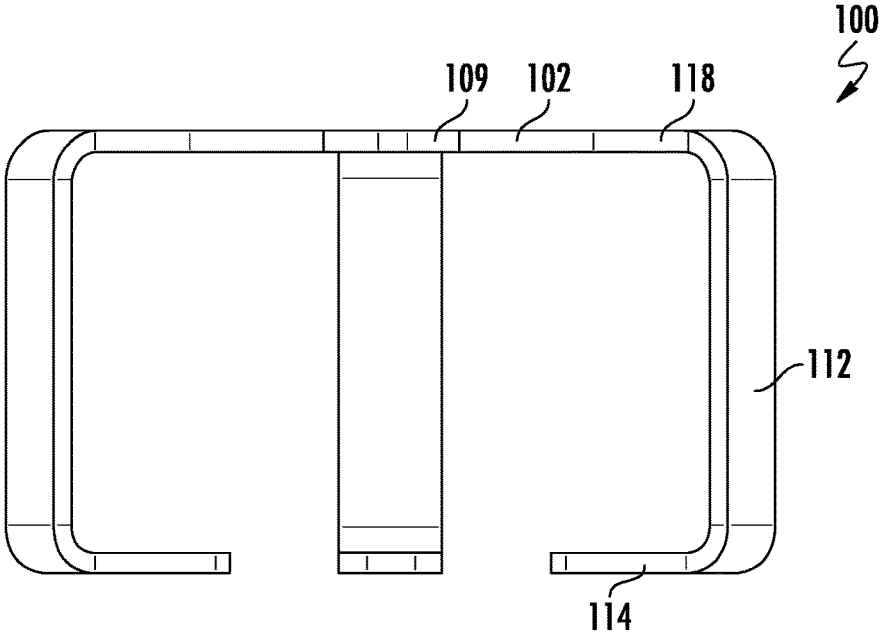
FIG. 2 is a side view of the antenna mount of FIG. 1.

The present invention will now be described more fully hereinafter, in which embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. The device may be otherwise oriented (rotated 90 degrees or at other orientations) and the spatially relative descriptors used herein interpreted accordingly.

Well-known functions or constructions may not be described in detail for brevity and/or clarity.

Referring now to the drawings, a mount for a telecommunications antenna unit is illustrated in FIGS. 1-4 and designated broadly at 100. The mount 100 includes a main panel 102 with a central hole 103 and six spokes 105-110 extending radially outwardly therefrom. The odd-numbered spokes 105, 107, 109 are cantilevered members with unsupported free ends. An oblong slot 111 is present in each of the spokes 105, 107, 109. Each of the even-numbered spokes 106, 108, 110 is supported from underneath by a vertical member 112, which merges at its upper end with a respective spoke 106, 108, 110 and at its lower end with a flange 114. An oblong slot 116 is present in each of the spokes 106, 108, 110 and extends slightly into the main panel 102. Also, an oblong slot 118 is present in each of the flanges 114.

Figure 3:
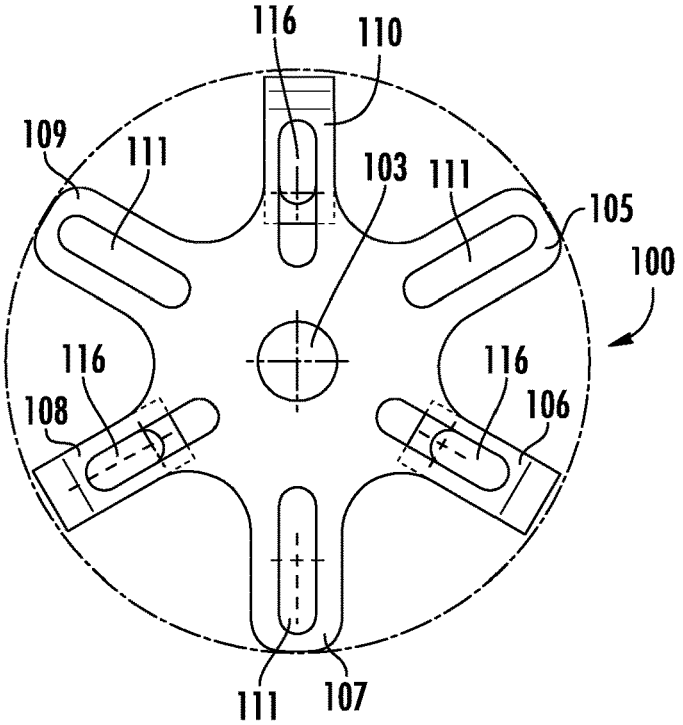
FIG. 3 is a top view of the antenna mount of FIG. 1.
Figure 4:
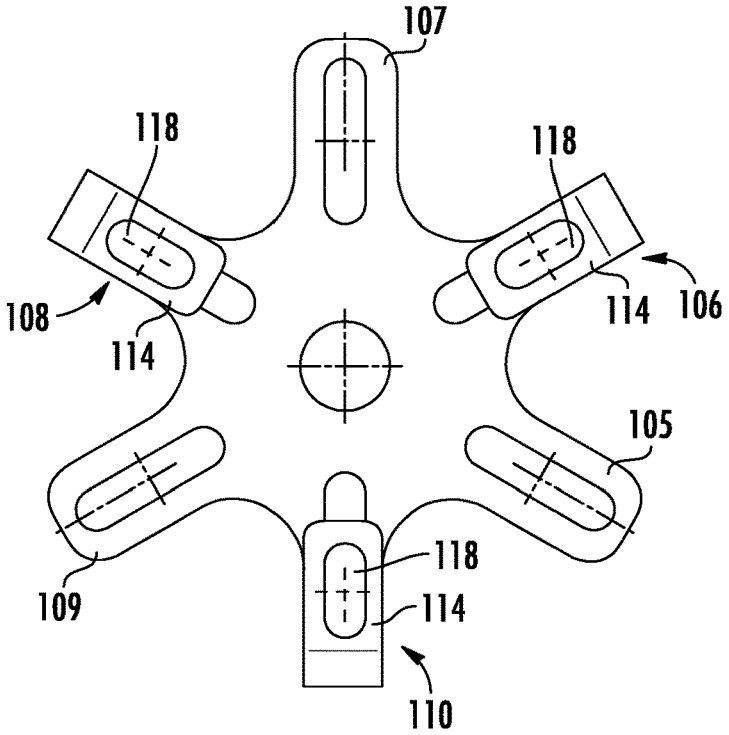
FIG. 4 is a bottom view of the antenna mount of FIG. 1.

As can be seen in FIG. 3, in the illustrated embodiment the odd-numbered spokes 105, 107, 109 extend radially outwardly from the main panel 102 a similar distance to that of the even-numbered spokes 106, 108, 110. The slots 111 are similar in size to the slots 116, but are positioned slightly radially outwardly of the slots 116. The slots 118 in the flanges 114 are somewhat shorter than the slots 111, 116 and are positioned such that the radially-outward ends of the slots 118 generally align with the radially-outward ends of the slots 116.

Figure 5:
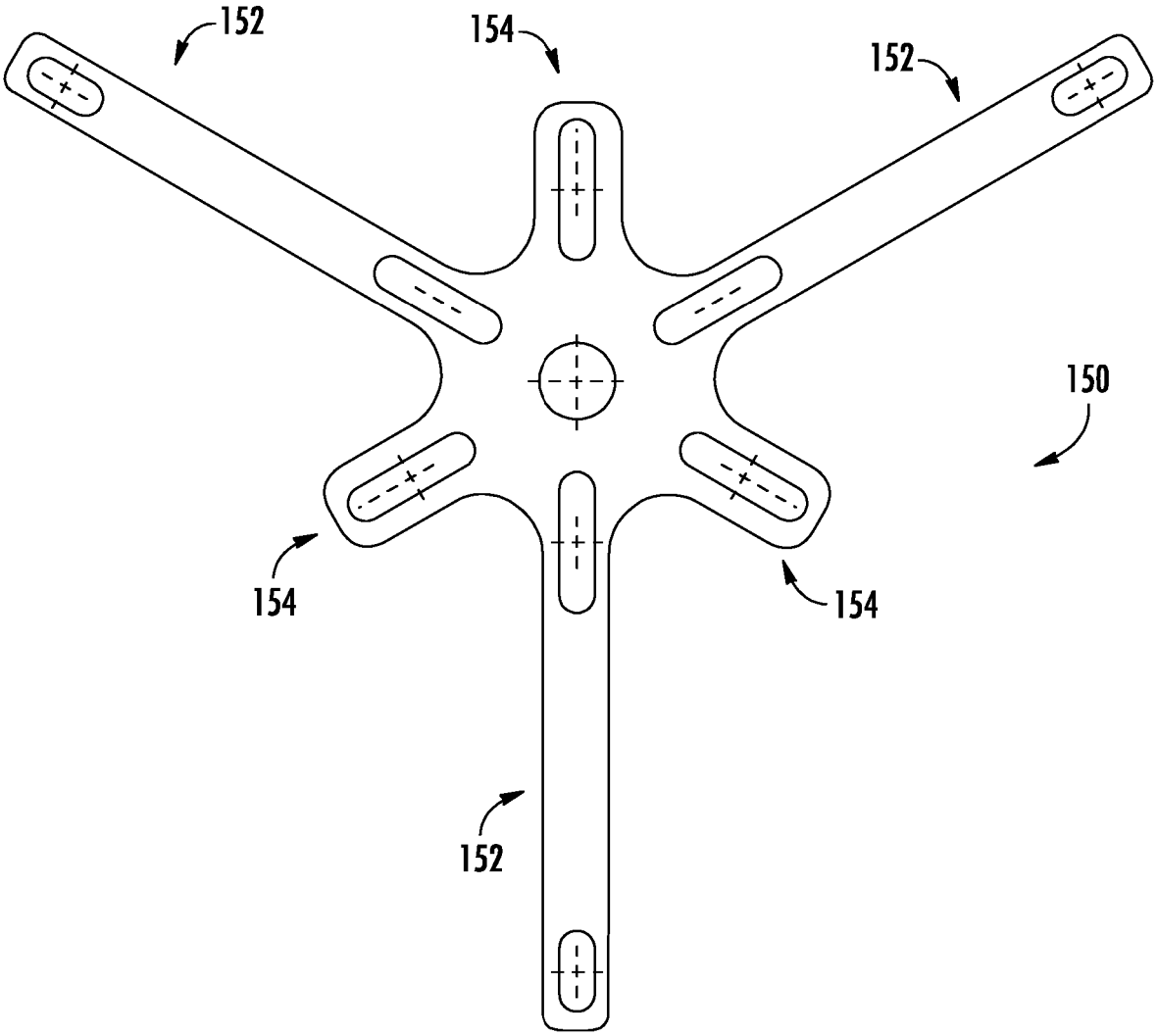
FIG. 5 is a top view of a blank that can be used to form the antenna mount of FIG. 1.

FIG. 5 shows that the mount 100 can be formed from a flat blank 150. The flat blank 150 can be created from a flat sheet of material, such as steel, by any number of methods, such as stamping. The longer extensions 152 of the blank 150 can then be bent twice to form the spokes 106, 108, 110, the vertical members 112 and the flanges 114. The shorter extensions 154 of the blank 150 are not bent and remain coplanar with the main panel 102 to form the spokes 105, 107, 109.

Figure 6:
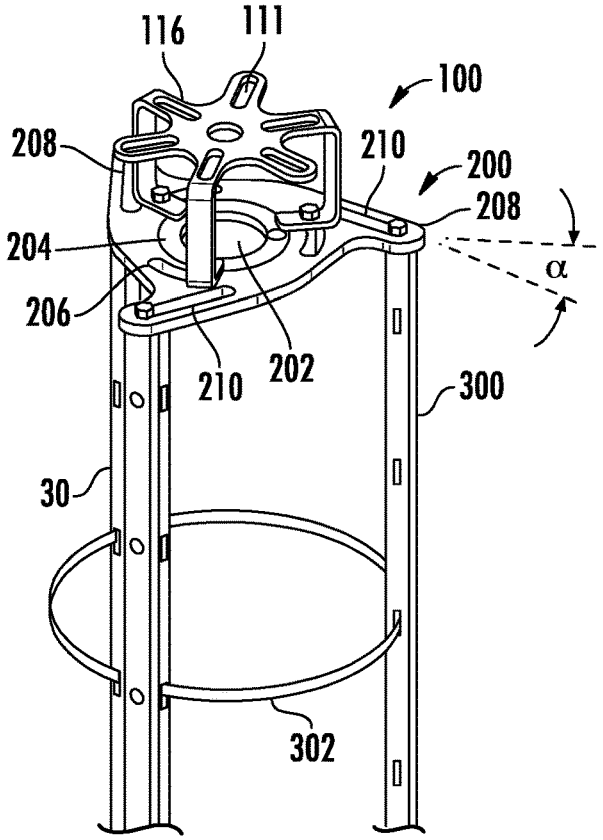
FIG. 6 is a top perspective view of the antenna mount of FIG. 1 mounted atop the supports of a monopole via a base plate according to embodiments of the invention, with the antenna mount in a first orientation.
Figure 6A:
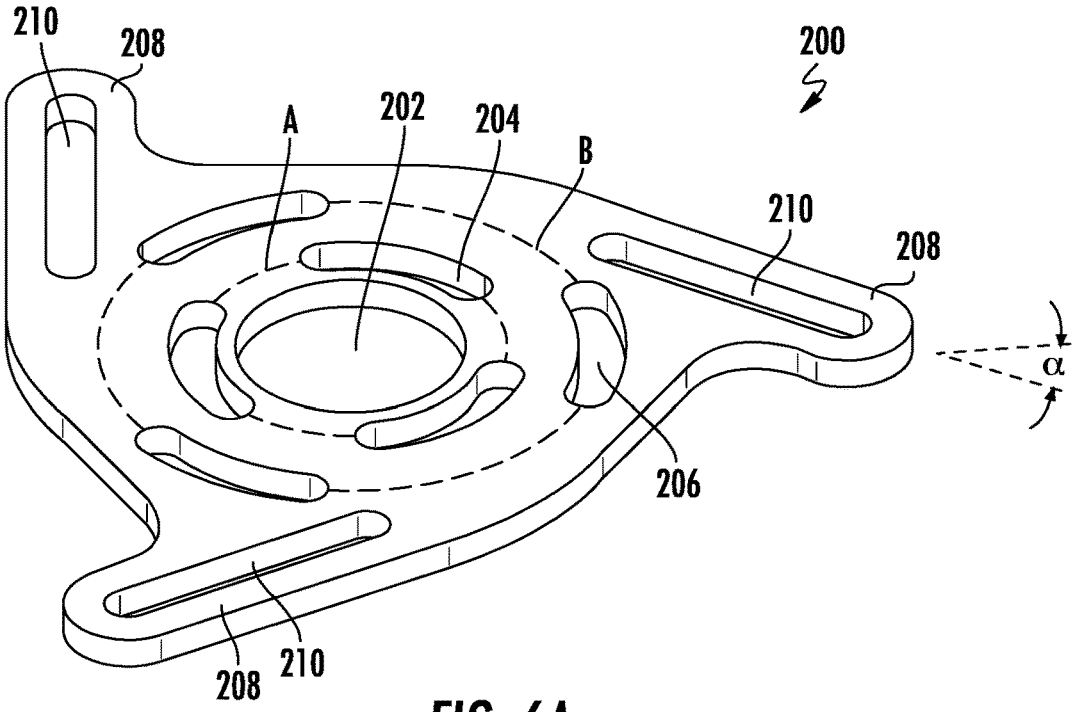
FIG. 6A is a top perspective view of the base plate of FIG. 6.

As can be seen in FIG. 6, the mount 100 can be employed to serve as a mounting point for a cylindrical antenna unit. The mount 100 can be mounted on a base plate 200, which in turn is mounted on three supports 300 (reinforced by a ring 302) that extend from the top of a monopole (not shown). As shown in FIG. 6A, the base plate 200 is generally planar and somewhat triangular in shape. A hole 202 is present in the center of the base plate 200 to provide routing for cables. Two different sets of three discontinuous slots are present in the base plate 200; one set of slots 204 is adjacent the hole 202 and defines a circle A; and a second set of slots 206 is radially outwardly of the slots 204 and defines a circle B that is larger in diameter than circle A. Three extensions 208 extend radially outwardly from locations separated by about 120 degrees. Each of the extensions 208 extends at an oblique angle of between about 30 and 70 degrees relative to an imaginary diameter of the base plate 200 (see FIG. 6, which shows an oblique angle a of about 45 degrees). Also, an oblong slot 210 is present in each of the extensions 208.

As can be seen in FIG. 6, the base plate 200 can be attached to the supports 300 of a monopole via screws or other fasteners that are inserted into the slots 210 in the extensions 208. The oblique orientation of the slots 210 can enable the base plate 200 to be mounted on monopoles having supports 300 with different spacing by simply rotating the base plate 200; in one embodiment, the slots 210 have a length of about 4 inches and are skewed from the diameter at angle of 45 degrees, which enables the base plate 200 to be mounted on monopoles that are 5 to 11 inches in diameter.

Once the base plate 200 is mounted on the monopole, the mount 100 can then be mounted on the base plate 200. In the orientation shown in FIG. 6, the mount is attached to the base plate 200 via fasteners inserted through the slots 204 of the base plate 200 and the slots 114 of the mount 100. This arrangement presents the main panel 102 and slots 111, 116 of the mount 100 for potential mounting of an antenna via screws or other threaded fasteners inserted through the slots 111 or the slots 116. These slots 111, 116 can serve to mount a large number of different antennas.

In addition, the slots 204, 206 are of sufficient arc length (typically between about 30 and 70 degrees) that the mount 100 can be mounted relative to the base plate 200 over a range of angular orientations. This enables the mount 100 to be rotated to a desired angular position for the mounting of the antenna thereon.

Figure 7:
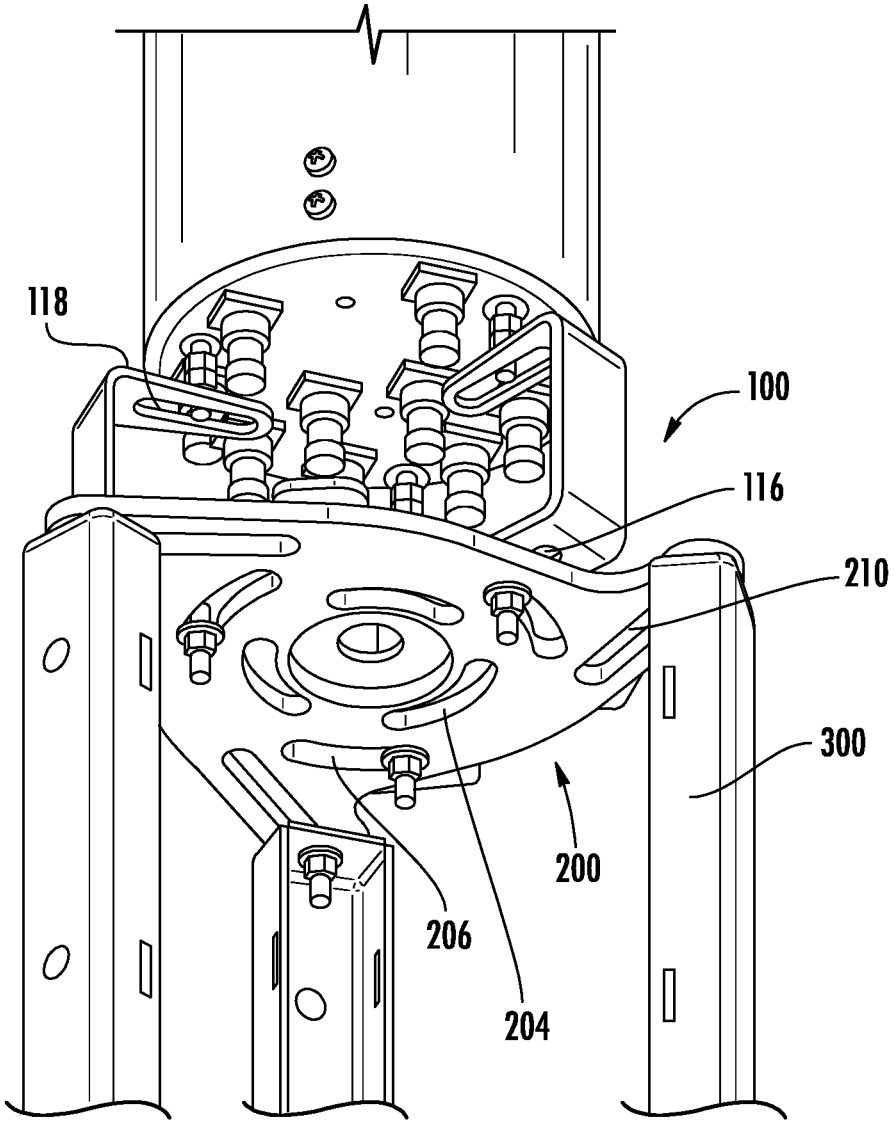
FIG. 7 is a bottom perspective view of the antenna mount of FIG. 1 mounted on the base plate of FIG. 6 in a second, inverted orientation.

Alternatively, as shown in FIG. 7, the mount 100 can be mounted "upside-down" on the base plate 200, with screws or other fasteners inserted through the slots 206 of the base plate 200 and through the slots 116 of the mount 100. This orientation presents the flanges 114 and their slots 118 for mounting of an antenna.

Figure 8:
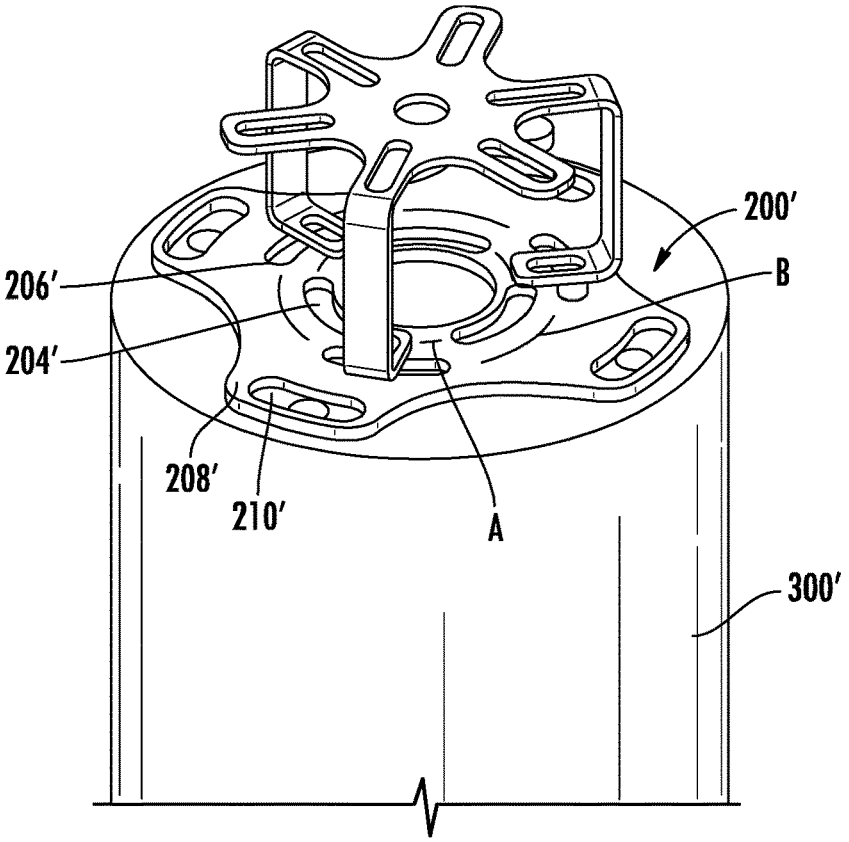
FIG. 8 is a top perspective view of the antenna mount of FIG. 1 mounted on a base plate according to alternative embodiments of the invention.

As another alternative, the mount 100 can be mounted to a base plate 200' of a different configuration (see FIG. 8). The base plate 200' has two sets of slots 204', 206' similar to the slots 204, 206 of the base plate 200. However, the base plate 200' has four extensions 208' that extend radially outwardly of the main panel 202', each of which includes a slot 210' that is generally circumferentially disposed. This arrangement may be well-suited for the attachment of the base plate 200' (and subsequently the mount 100) to the top surface of a monopole 300' that lacks supports 300.

Figure 9:
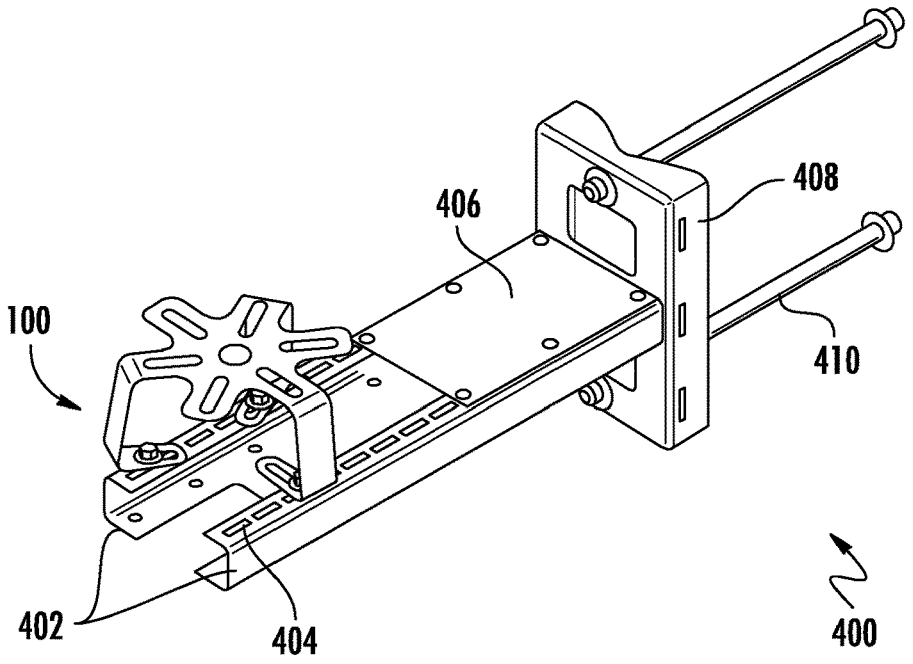
FIG. 9 is a top perspective view of the antenna mount of FIG. 1 mounted on a side-mount platform according to embodiments of the invention.

As another alternative, the mount 100 can be employed with a side mounted antenna via a cantilevered mounting platform 400. The mounting platform 400 includes two rails 402 with mounting holes 404. In some embodiments, a strengthening cover 406 may also be attached to the rails 402. The platform 400 also includes a vertical mounting box 408 that can be mounted to a pole or other structure via rods 410. Once mounted on the mounting structure, the platform 400 can serve as a mounting location for a mount 100, either in the orientation shown in FIG. 9 (which matches that of FIG. 6), or in the upside-down orientation of FIG. 10. In either orientation, the mount 100 can support an antenna from underneath.

Figure 10:
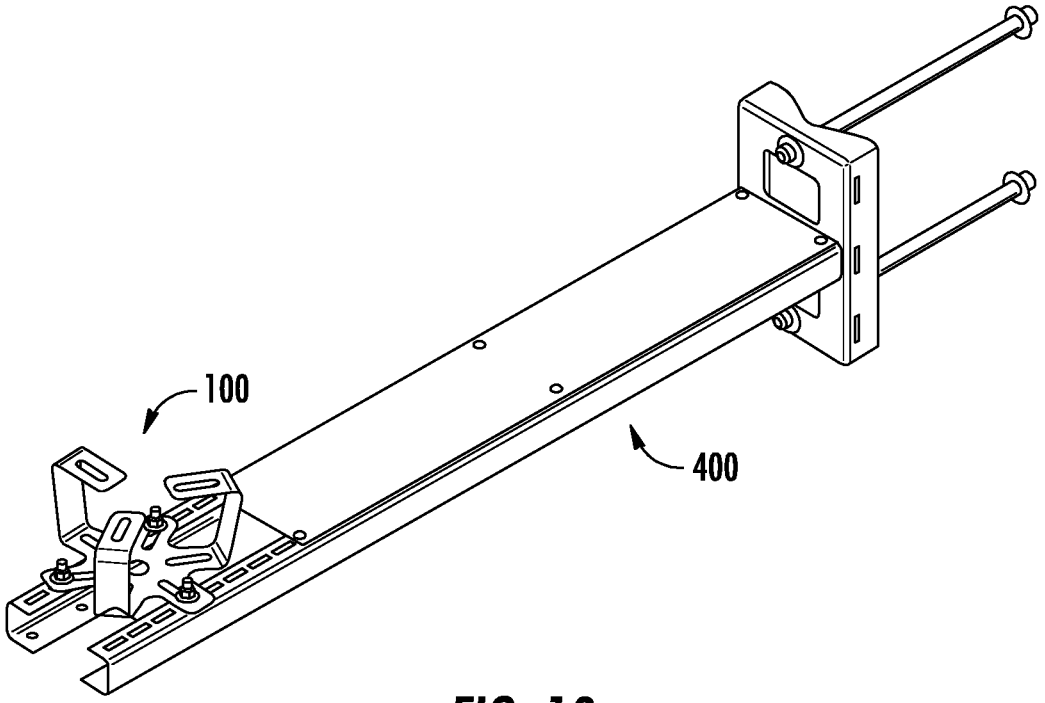
FIG. 10 is a top perspective view of the antenna mount of FIG. 1 mounted in its inverted orientation on a side-mount platform.
Figure 11:
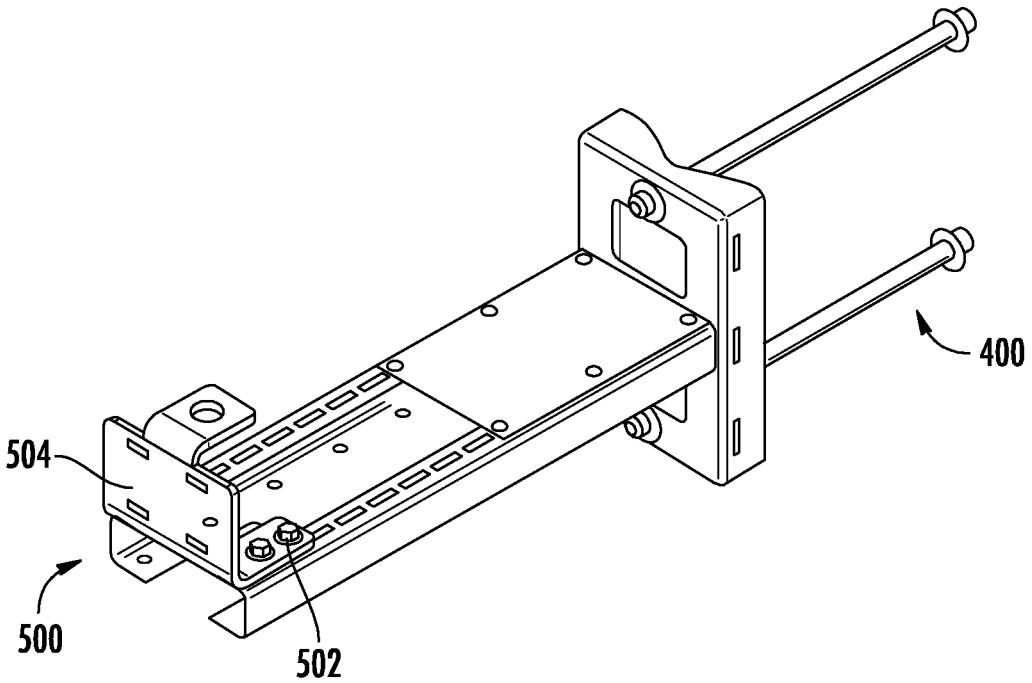
FIG. 11 is a top perspective view of the side-mounting platform of FIG. 9 with a C-shaped mounting bracket mounted thereon.

As a further alternative, the mounting platform 400 may be employed with a C-shaped bracket 500 that mounts via a flange 502 on the rails 402 and provides a vertical surface 504 for the mounting of a panel antenna (see FIG. 10).

The mount 100 and base plate 200 are typically formed of a metallic material, such as steel or aluminum. The mount 100 may be of any thickness, but should be of sufficient thickness to provide a rigid mounting location for the antenna; a thickness of between about 0.188 and 0.375 inch is typical. Similarly, the base plate 200 may be should be of sufficient thickness to provide a rigid mounting location for the antenna; a thickness of between about 0.188 and 0.375 inch is typical.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A mount for an antenna, the mount comprising:

a base panel;

a plurality of first spokes extending radially outwardly from the base panel, each of the first spokes being cantilevered and including a first slot; and a plurality of second spokes extending radially outwardly from the base panel, each of the second spokes including a vertical member and a flange that is parallel with the base panel and perpendicular to the vertical member, each of the second spokes including a second slot, and each of the flanges including a third slot, wherein the plurality of first spokes symmetrically alternate with the plurality of second spokes from the base panel.

2. The mount defined in claim 1, wherein second radially inward ends of the second slots are radially inward of first radially inward ends of the first slots.

3. The mount defined in claim 1, wherein the first, second and third slots are oblong slots.

4. The mount defined in claim 1, wherein second radially inward ends of the second slots are radially inward of third radially inward ends of the third slots.

5. The mount defined in claim 1, wherein the plurality of first spokes is three spokes, and the plurality of second spokes is three spokes.

6. The mount defined in claim 1, mounted to a base plate via fasteners inserted through the third slots.

7. The mount defined in claim 6, in combination with the antenna mounted to the mount via fasteners inserted through the first slots or the second slots.

8. The mount defined in claim 1, mounted to a base plate via fasteners inserted through the first slots or the second slots.

9. The mount defined in claim 8, in combination with the antenna mounted to the mount via fasteners inserted through the third slots.

10. A mount for an antenna, the mount comprising:

a base panel;

three first spokes extending radially outwardly from the base panel, each of the first spokes being cantilevered and including a first slot; and three second spokes extending radially outwardly from the base panel, each of the second spokes including a vertical member and a flange that is parallel with the base panel and perpendicular to the vertical member, each of the second spokes including a second slot, and each of the flanges including a third slot;

wherein the first, second and third slots are oblong slots.

11. The mount defined in claim 10, wherein second radially inward ends of the second slots are radially inward of first radially inward ends of the first slots.

12. The mount defined in claim 10, wherein second radially inward ends of the second slots are radially inward of third radially inward ends of the third slots.

13. The mount defined in claim 10, mounted to a base plate via fasteners inserted through the third slots.

14. The mount defined in claim 13, in combination with the antenna mounted to the mount via fasteners inserted through the first slots or the second slots.

15. The mount defined in claim 10, mounted to a base plate via fasteners inserted through the first slots or the second slots.

16. The mount defined in claim 15, in combination with the antenna mounted to the mount via fasteners inserted through the third slots.

17. A mount for an antenna, the mount comprising:

a base panel;

a plurality of first spokes extending radially outwardly from the base panel, each of the first spokes being cantilevered and including a first slot; and a plurality of second spokes extending radially outwardly from the base panel, each of the second spokes including a vertical member and a flange that is generally parallel with the base panel and generally perpendicular to the vertical member, each of the second spokes including a second slot, and each of the flanges including a third slot;

wherein second radially inward ends of the second slots are radially inward of first radially inward ends of the first slots, and wherein the second radially inward ends of the second slots are radially inward of third radially inward ends of the third slots.

18. The mount defined in claim 17, mounted to a base plate via fasteners inserted through the first slots or the second slots.

19. The mount defined in claim 18, in combination with the antenna mounted to the mount via fasteners inserted through the third slots.

* * * * *